US008068757B2

(12) United States Patent
Hashiguchi

(10) Patent No.: US 8,068,757 B2
(45) Date of Patent: Nov. 29, 2011

(54) IMAGE FORMING APPARATUS

(75) Inventor: Shinji Hashiguchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 236 days.

(21) Appl. No.: 12/556,062

(22) Filed: Sep. 9, 2009

(65) Prior Publication Data

US 2010/0074661 A1 Mar. 25, 2010

(30) Foreign Application Priority Data

Sep. 24, 2008 (JP) ..... 2008-244274
Aug. 5, 2009 (JP) ..... 2009-182097

(51) Int. Cl.
*G03G 15/20* (2006.01)

(52) U.S. Cl. ..... 399/67; 399/21; 399/33; 399/328; 399/331

(58) Field of Classification Search ..... 399/21, 399/33, 67, 328, 331
See application file for complete search history.

(56) References Cited

U.S. PATENT DOCUMENTS

| | | | | |
|---|---|---|---|---|
| 5,148,226 | A | 9/1992 | Setoriyama et al. | 355/290 |
| 7,190,914 | B2 | 3/2007 | Nihonyanagi et al. | |
| 7,215,899 | B2 | 5/2007 | Kimizuka et al. | |
| 7,251,447 | B2 | 7/2007 | Kanamori et al. | |
| 7,280,775 | B2 | 10/2007 | Kubochi et al. | |
| 7,518,089 | B2 | 4/2009 | Hashiguchi et al. | |
| 2008/0181662 | A1* | 7/2008 | Lee et al. | 399/126 |
| 2009/0297236 | A1 | 12/2009 | Saito et al. | |

FOREIGN PATENT DOCUMENTS

| | | |
|---|---|---|
| JP | 63-313182 | 12/1988 |
| JP | 2-157878 | 6/1990 |
| JP | 4-044075 | 2/1992 |
| JP | 4-044076 | 2/1992 |
| JP | 4-044077 | 2/1992 |
| JP | 4-044078 | 2/1992 |
| JP | 4-044079 | 2/1992 |
| JP | 4-044080 | 2/1992 |
| JP | 4-044081 | 2/1992 |
| JP | 4-044082 | 2/1992 |
| JP | 4-044083 | 2/1992 |
| JP | 4-204980 | 7/1992 |
| JP | 4-204981 | 7/1992 |
| JP | 4-204982 | 7/1992 |
| JP | 4-204983 | 7/1992 |
| JP | 4-204984 | 7/1992 |
| JP | 2000-122460 | 4/2000 |

* cited by examiner

*Primary Examiner* — Ryan Walsh
(74) *Attorney, Agent, or Firm* — Fitzpatrick, Cella, Harper & Scinto

(57) ABSTRACT

In an image forming apparatus including a fixing portion in which a fixing nip portion is defined between a heater and a pressure roller via an endless belt, a pressure setting portion, which sets a pressure to be exerted on the fixing nip portion, sets a first pressure during fixing, sets a second pressure lower than the first pressure when the apparatus is not used, and sets a third pressure lower than the first pressure and higher than the second pressure when a recording material is jammed.

2 Claims, 13 Drawing Sheets

*FIG. 8*

| PRESSURE | 2kgf | 3kgf | 4kgf | 5kgf |
|---|---|---|---|---|
| ELASTIC LAYER DEFORMATION PHENOMENON | ○ | ○△ | △ | △ |

○ : NONE △ : SLIGHT

FIG. 12

| | PRESSURE | | |
|---|---|---|---|
| | 28 kgf OR HIGHER | 5 kgf TO 8 kgf | 2 kgf OR LOWER |
| NORMAL PRINTING | GOOD | DEFICIENT FIXING | DEFICIENT FIXING |
| JAM RECOVERY | DIFFICULT | GOOD | BREAKAGE OF SLEEVE |
| STORAGE FOR LONG PERIOD OF TIME | ELASTIC LAYER DEFORMATION PHENOMENON | ELASTIC LAYER DEFORMATION PHENOMENON | GOOD |

IMAGE FORMING APPARATUS

BACKGROUND OF THE INVENTION

1. Field of the Invention

The present invention relates to an image forming apparatus which includes a fixing portion having an endless belt, a heater disposed in contact with the inner surface of the endless belt, and a pressure roller defining a fixing nip portion with the heater via the endless belt, and forms a toner image on a recording material.

2. Description of the Related Art

A thermal roller fixing system or a film heating system has been conventionally adopted as heating/fixing portion for a copying machine or a printer of an electrophotographic system. In particular, the film heating system enables a fixing member to speedily rise up in temperature during printing while suppressing power consumption on standby to a low level, and therefore, has attracted attention as a heating system of an energy saving type.

A fixing device (an on-demand fixing device) of the film heating system is disclosed in, for example, Japanese Patent Application Laid-open (JP-A) Nos. 63-313182, 2-157878, 4-44075 to 4-44083, and 4-204980 to 4-204984. FIG. 13 illustrates a typical example of the fixing device of the film heating system. A film assembly 60 is illustrated in FIG. 13. A heater 61 having an energization heat generation resistant layer formed on a ceramic substrate made of alumina or aluminum nitride is fixed to a stay holder 62 made of a heat resistant resin. The fixing device includes a heat resistant, thin fixing film (i.e., an endless belt) 63 which is loosely fitted around the stay holder 62 and is made of a resin such as polyimide or metal such as SUS (stainless).

The heater 61 in the film assembly 60 and a pressure roller 50 are brought into press-contact with each other while holding the fixing film 63 therebetween, thereby defining a fixing nip portion.

The pressure roller 50 includes an elastic layer 52 made of silicone rubber and a toner parting layer 53 made of a fluorocarbon resin around a cored bar 51. The fixing film 63 is conveyed and moved in a direction indicated by an arrow while sliding in close contact with the heater 61 at the fixing nip portion by the rotational driving force of the pressure roller 50 in the arrowed direction. The temperature of the heater 61 is detected by a thermistor 64 disposed on the back of the heater, to be fed back to an energization control portion, not illustrated, so that the heater 61 is heated and adjusted so as to be kept at a predetermined temperature (i.e., a fixing temperature). An image forming apparatus using the fixing device of the film heating system has a high heating efficiency and speedily rises up in temperature, and thus, has more advantages, such as the lack of any need preliminary heating on standby and a shortened waiting time, than an image forming apparatus using a conventional fixing device of a thermal roller system.

The pressure provided by the fixing device needs to be normally increased during printing. However, the pressure needs be set to a lower level in order to readily remove a recording material nipped at the fixing nip portion when the recording material staying at the fixing nip portion due to paper jamming is removed (hereinafter it is referred to as jam recovery). Otherwise, when the image forming apparatus is left unused for a long period of time or before the image forming apparatus is shipped, the pressure needs be set to a lower level in order to prevent deformation of the pressure roller and the endless belt. As a countermeasure against such a problem to be solved, the jam recovery is improved or the deformation of the endless belt and the pressure roller is prevented by setting the pressure to be exerted on the fixing nip portion to a lower level during the jam recovery or non-use in comparison with during normal printing, as disclosed in JP-A No. 2000-122460.

However, a heater may not be bonded to a heater holder in order to prevent a crack of the heater due to a difference in thermal expansion between the heater and the heater holder in the heating/fixing device of the film heating system. With such a configuration, a lower limit of the pressure is restricted during the jam recovery. That is to say, the heater is separated from the heater holder under a too low pressure, so that an edge of the heater projects from the heater holder. If the jam recovery is performed in such a state, the inner surface of the fixing film is damaged by the edge of the heater when the fixing film is rotated. When the heating/fixing device is continuously used while the inner surface of the fixing film is damaged, the fixing film may be possibly broken. To the contrary, when the fixing film and the pressure roller are completely separated from each other such that the fixing film cannot be damaged even during the jam recovery, a space for a pressure mechanism must be sufficiently provided.

Alternatively, when the image forming apparatus is stored for a long period of time while the pressure is set such that the edge of the heater cannot project from the heater holder, a phenomenon of deformation of the elastic layer of the pressure roller or the fixing film (hereinafter referred to as "an elastic layer deformation phenomenon") may occur. The elastic layer deformation phenomenon induces deformation of specific portions of the fixing film and the pressure roller that are press contacted for a long period of time, thereby raising a problem of degradation of uniformity of an image at the deformed portion.

As described above, when the pressures during the jam recovery and the non-use are set to the same level, it may be difficult to prevent the breakage of the fixing film and the deformation of the pressure roller or the fixing film at the same time.

SUMMARY OF THE INVENTION

The present invention has been made in view of the problems, and the present invention provides an image forming apparatus in which breakage of an endless belt during jam recovery and deformation of a pressure roller or the endless belt can be suppressed at the same time.

Moreover, the present invention provides an image forming apparatus comprising: an image forming portion which forms a toner image on a recording material; a fixing portion which fixes, onto the recording material, the toner image formed on the recording material, the fixing portion including an endless belt, a heater in contact with the inner surface of the endless belt, and a pressure roller which defines a fixing nip portion in cooperation with the heater via the endless belt; and a pressure setting portion which sets a pressure to be exerted on the fixing nip portion, the pressure setting portion setting a first pressure during fixing and setting a second pressure lower than the first pressure when the apparatus is not used. The pressure setting portion sets a third pressure lower than the first pressure and higher than the second pressure when the recording material is jammed.

Further features of the present invention will become apparent from the following description of exemplary embodiments with reference to the attached drawings.

BRIEF DESCRIPTION OF THE DRAWINGS

FIG. 8 is a table summarizing pressures at which an elastic layer deformation phenomenon occurs.

FIG. 12 is a table illustrating problems when the pressure is varied in each of the states of the fixing portion.

DESCRIPTION OF THE EMBODIMENTS

An exemplary embodiment according to the present invention will be descried below in detail with reference to the attached drawings. Here, dimensions, materials, shapes of constituent parts described in the embodiment and their relative arrangement should be appropriately varied according to configurations or various conditions of an apparatus to which the present invention is applied, and therefore, the scope of the present invention is not limited to the following embodiment.

Figure 1:
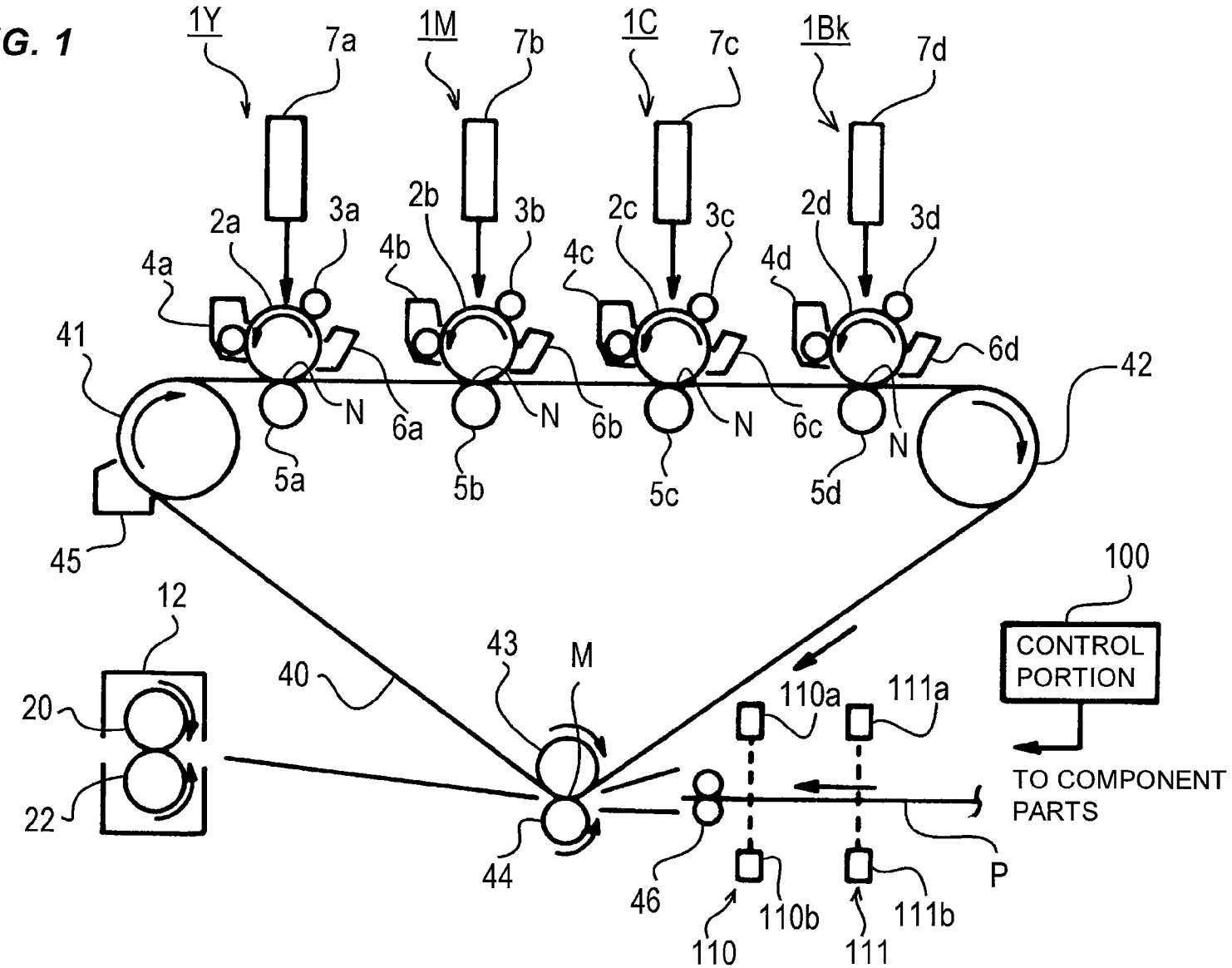
FIG. 1 is a cross-sectional view illustrating an image forming apparatus in an embodiment according to the present invention.

First Embodiment (1) General Configuration of Image Forming Apparatus FIG. 1 is a view schematically illustrating the configuration of a color image forming apparatus in a first embodiment according to the present invention. The image forming apparatus in the present embodiment exemplifies a full color printer of an electrophotographic tandem type through which a sheet of A3 size can pass at the maximum.

The image forming apparatus includes four image forming portions (i.e., image forming portion), that is, an image forming portion 1Y for forming a yellow image, an image forming portion 1M for forming a magenta image, an image forming portion 1C for forming a cyan image, and an image forming portion 1Bk for forming a black image. These four image forming portions are aligned at a predetermined interval.

The image forming portions 1Y, 1M, 1C, and 1Bk include photosensitive drums 2*a*, 2*b*, 2*c*, and 2*d*, respectively. Charging rollers 3*a*, 3*b*, 3*c*, and 3*d*, developing devices 4*a*, 4*b*, 4*c*, and 4*d*, primary transfer rollers 5*a*, 5*b*, 5*c*, and 5*d*, and drum cleaners 6*a*, 6*b*, 6*c*, and 6*d* are arranged around the photosensitive drums 2*a*, 2*b*, 2*c*, and 2*d*, respectively. Exposing devices 7*a*, 7*b*, 7*c*, and 7*d* are disposed above and between the charging rollers 3*a*, 3*b*, 3*c*, and 3*d* and the developing devices 4*a*, 4*b*, 4*c*, and 4*d*, respectively. The developing devices 4*a*, 4*b*, 4*c*, and 4*d* contain therein a yellow toner, a magenta toner, a cyan toner, and a black toner, respectively.

The photosensitive drums 2*a*, 2*b*, 2*c*, and 2*d* in the image forming portions 1Y, 1M, 1C, and 1Bk abut against an endless intermediate transfer belt 40 serving as a transfer medium, thereby forming primary transfer portions N. The intermediate transfer belt 40 is stretched between a drive roller 41, a support roller 42, and a secondary transfer counter roller 43, and thus, is rotated (moved) in a direction indicated by an arrow (i.e., clockwise) by the driving of the drive roller 41.

The primary transfer rollers 5*a*, 5*b*, 5*c*, and 5*d* abut against the photosensitive drums 2*a*, 2*b*, 2*c*, and 2*d* at the primary transfer nip portions N, respectively, while holding the intermediate transfer belt 40 therebetween.

The secondary transfer counter roller 43 abuts against a secondary transfer roller 44 while holding the intermediate transfer belt 40 therebetween, thereby forming a secondary transfer portion M. The secondary transfer roller 44 is disposed to be separable with respect to the intermediate transfer belt 40.

In the vicinity of the drive roller 41 and outside of the intermediate transfer belt 40 is disposed a belt cleaner 45 for removing and recovering a transfer residual toner remaining on the intermediate transfer belt 40.

In addition, a fixing device 12 is disposed downstream of the secondary transfer portion M in a conveyance direction of a recording material P.

Upon issuance of an image forming operation starting signal, the photosensitive drums 2*a*, 2*b*, 2*c*, and 2*d* in the image forming portions 1Y, 1M, 1C, and 1B*k*, which are rotatably driven at a predetermined process speed are uniformly charged to a negative polarity, in the present embodiment, by the charging rollers 3*a*, 3*b*, 3*c*, and 3*d*, respectively.

The exposing devices 7*a*, 7*b*, 7*c*, and 7*d* convert color-separated image signals to be input into optical signals by laser output portions, not illustrated, respectively. Laser beams in response to the converted optical signals scan and expose the charged photosensitive drums 2*a*, 2*b*, 2*c*, and 2*d*, thereby forming electrostatic latent images thereon.

First, the yellow toner is electrostatically adsorbed onto the photosensitive drum 2*a* having the electrostatic latent image formed thereon in accordance with a charged potential on a photosensitive member by the developing device 4*a*, to which a development bias having the same polarity as the charging polarity (i.e., the negative polarity) of the photosensitive drum 2*a* is applied, thus developing the electrostatic latent image so as to form a development image. The yellow toner image is primarily transferred onto the rotating intermediate transfer belt 40 at the primary transfer portion N by the primary transfer roller 5*a*, to which a primary transfer bias (having a polarity opposite to that of the toner, that is, a positive polarity) is applied. The intermediate transfer belt 40, to which the yellow toner image is transferred, is rotated toward the image forming portion 1M.

Next, a magenta toner image formed on the photosensitive drum 2*b* is superimposed on the yellow toner image on the intermediate transfer belt 40 in the same manner also in the image forming portion 1M, to be transferred in the primary transfer portion N.

Hereinafter, cyan and black toner images formed on the photosensitive drums 2*c* and 2*d* in the image forming portions 1C and 1Bk, respectively, are superimposed at the primary transfer portions N in sequence on the yellow and magenta toner images superimposed and transferred onto the intermediate transfer belt 40 in the same manner. In this manner, a full color toner image is formed on the intermediate transfer belt 40.

At a timing when the tip of the full color toner image formed on the intermediate transfer belt 40 is moved to the secondary transfer portion M, the recording material P is conveyed to the secondary transfer portion M by a pair of registration rollers 46. The full color toner image is secondarily transferred onto the recording material P at one time by the secondary transfer roller 44, to which a secondary transfer bias (having a polarity opposite to that of the toner, that is, a positive polarity) is applied. The recording material P having the full color toner image formed thereon is conveyed to the fixing device 12. The full color toner image is heated and pressure is applied thereto at a fixing nip portion defined between a fixing film 20 and a pressure roller 22, to be fused and fixed onto the recording material P. Thereafter, the recording material P is discharged to the outside, so that an output image in the image forming apparatus is formed. In this manner, a series of image forming operations is completed.

The primary transfer residual toners remaining on the photosensitive drums 2*a*, 2*b*, 2*c*, and 2*d* after the primary transfer are removed and recovered by the drum cleaners 6*a*, 6*b*, 6*c*, and 6*d*, respectively. In addition, the secondary transfer residual toner remaining on the intermediate transfer belt 40 after the secondary transfer is removed and recovered by the belt cleaner 45.

Here, a control portion 100 is constituted of a CPU substrate for centralized-controlling component parts in the image forming apparatus.

Jam sensors (abnormal conveyance detecting unit) 110 and 111 detect abnormal conveyance of the recording material P. The jam sensors 110 and 111 include light irradiating portions 110*a* and 111*a* and light receiving portions 110*b* and 111*b*, respectively, and are adapted to detect the conveyance of the recording material P in response to the interruption of the light by the recording material P. When a detection pattern of the recording material P detected by the jam sensors 110 and 111 indicates an abnormal conveyance, the control portion 100 determines that the recording material P is jammed, stops the operations of the component parts, and lights a jam alarm lamp in the image forming apparatus.

Figure 2:
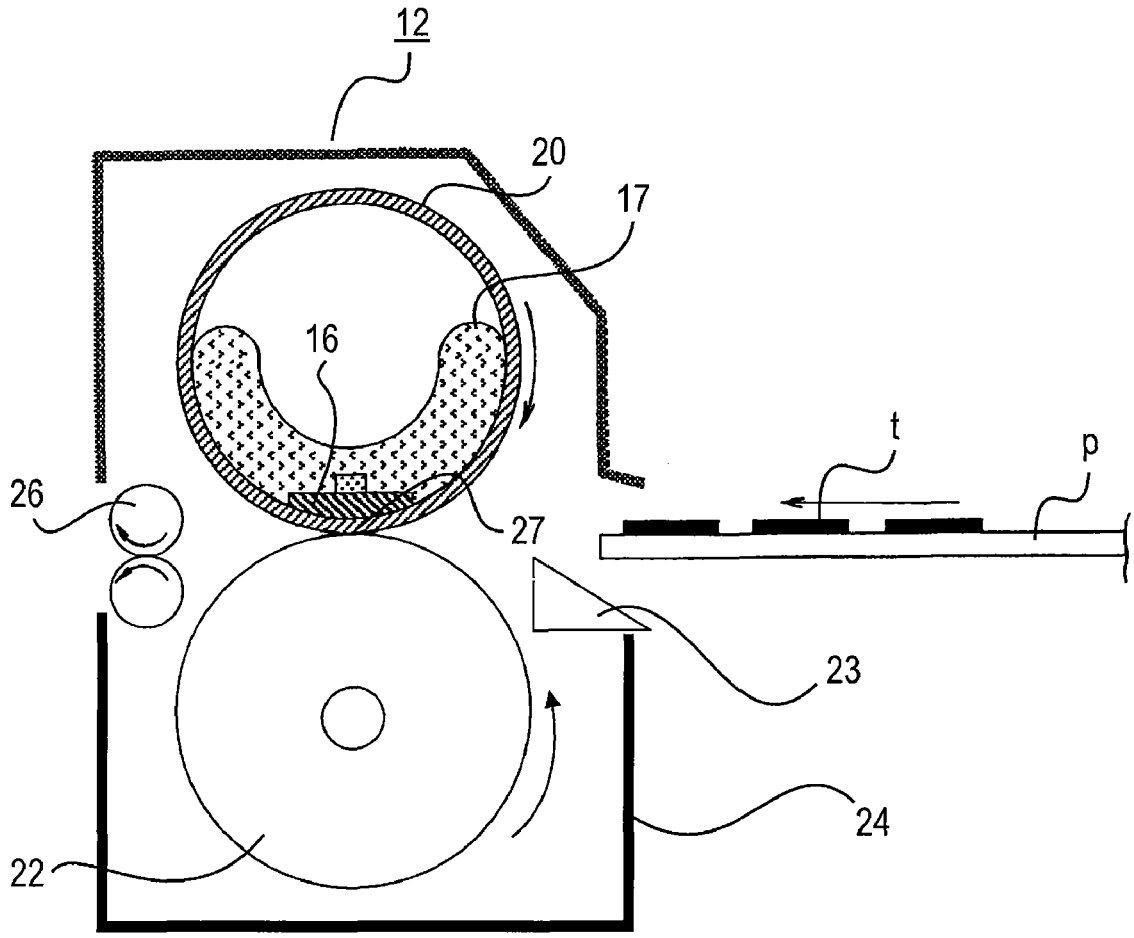
FIG. 2 is a cross-sectional view illustrating the configuration of a fixing with image forming apparatus illustrated in FIG. 1.

(2) Configuration of Fixing Device (Fixing Unit) FIG. 2 is a view schematically illustrating the configuration of the fixing device 12.

The fixing device 12 includes the fixing film 20 which is a cylindrical member having a belt-like elastic layer and the pressure roller 22. A heater holder (i.e., a holding member) 17 is formed into a substantially semi-arcuate bowl, as viewed in cross section, and has heat resistance and rigidity. A fixing heater (i.e., a heat generator) 16 is inserted into a recess formed at the lower surface of the heater holder 17 along the longitudinal direction of the heater holder 17. The fixing film 20 is loosely fitted around the heater holder 17.

A silicone rubber layer is formed on a stainless cored bar with a thickness of about 3 mm by injection molding, to be covered with a PFA resin (a tetrafluoroethylene-perfluoroalkylvinylether copolymer) tube in a thickness of about 40 μm, thereby obtaining the pressure roller 22. The cored bar of the pressure roller 22 is rotatably pivoted and held at both ends thereof between unillustrated side plates on the back and the front, of a fixing frame 24. Above the pressure roller 22, a fixing film portion including the heater 16, the heater holder 17, the fixing film 20, and the like is juxtaposed to the pressure roller 22 while the heater 16 is oriented downward.

The heater holder 17 is urged at both ends thereof against the pressure roller 22 by a force of 147 N (15 kgf) on either side, or 294 N (30 kgf) in total by a pressure mechanism, described later. A downward surface of the heater 16 is brought into press-contact with the elastic layer of the pressure roller 22 via the fixing film 20 against the elasticity of the elastic layer under a predetermined pressure, thereby defining a fixing nip portion 27 having a predetermined width required for heating and fixing. The pressure mechanism includes an automatic pressure varying mechanism, so as to vary the pressure, as described later. Moreover, there are provided an inlet guide 23 incorporated to the fixing frame 24 and a pair of fixing discharge rollers 26. The inlet guide 23 has the function of precisely guiding the recording material P having a non-fixed toner image t transferred at the secondary transfer portion M toward the fixing nip portion 27.

The inlet guide 23 in the present embodiment is made of a polyphenylene sulfide (PPS) resin. As described above, the fixing portion includes the endless belt 20, the heater 16 in contact with the inner surface of the endless belt 20, and the pressure roller 22 defining the fixing nip portion 27 with the heater 16 via the endless belt 20.

The pressure roller 22 is rotatably driven by drive means, not illustrated, at a predetermined circumferential speed in a direction indicated by an arrow, that is, counterclockwise. When the pressure roller 22 is rotated, a rotating force is exerted on the cylindrical fixing film 20 at the fixing nip portion 27 defined between the outer surface of the pressure roller 22 and the fixing film 20. While the inner surface of the fixing film 20 slides in close contact with the lower surface of the heater 16, the fixing film 20 is followably rotated in a direction indicated by an arrow, that is, clockwise around the heater holder 17. Grease is applied to the inner surface of the fixing film 20, thereby ensuring the slidability between the heater holder 17 and the inner surface of the fixing film 20.

The pressure roller 22 is rotatably driven, and accordingly, the cylindrical fixing film 20 is followably rotated. Meanwhile, the heater 16 is energized. When the heater 16 is increased in temperature, to rise up and be adjusted at a predetermined temperature, the recording material P bearing the non-fixed toner image thereon is guided between the fixing film 20 and the pressure roller 22 at the fixing nip portion 27 through the inlet guide 23. The recording material P is nipped and conveyed through the fixing nip portion 27 following the fixing film 20 while the surface of the recording material P bearing the toner image thereon is brought into close contact with the outer surface of the fixing film 20 at the fixing nip portion 27. During the nipping and conveying process, the heat of the heater 16 is applied to the recording material P via the fixing film 20, so that the non-fixed toner image t on the recording material P is heated and pressed onto the recording material P, thus to be fused and fixed thereon. The recording material P passing through the fixing nip portion 27 is curvature-separated from the fixing film 20, to be then discharged by the fixing discharge rollers 26.

Figure 3:
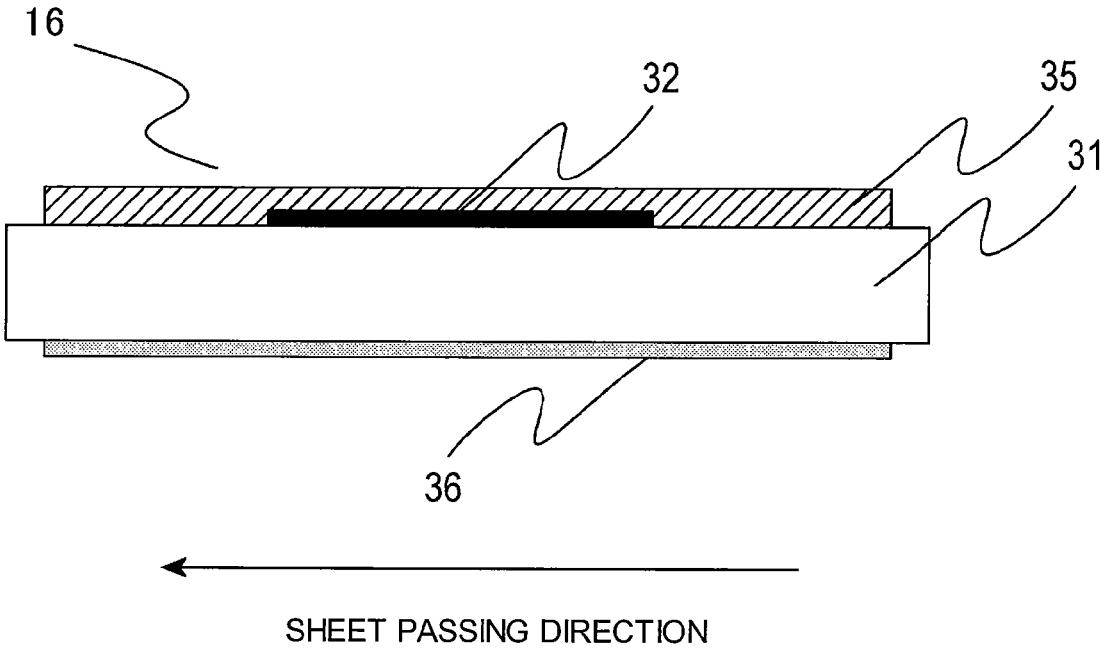
FIG. 3 is a cross-sectional view illustrating the configuration of a heater mounted on the fixing portion illustrated in FIG. 2.

FIG. 3 is a cross-sectional view illustrating the heater 16.

The heater 16 includes a rectangular alumina substrate 31 in which the longitudinal direction is perpendicular to a sheet passing direction. A resistant heat generator layer 32 is applied onto the back of the alumina substrate 31 by screen-printing in a linear or belt-like manner along the longitudinal direction, to generate heat caused by a current flow. The resistant heat generator layer 32 is obtained by printing conductive paste containing a silver-palladium (Ag/Pd) alloy on the alumina substrate 31 in a thickness of about 10 μm and a width of about 3 mm in the sheet passing direction. An electrode, not illustrated, formed by screen-printing silver paste is disposed, as a power supplying pattern with respect to the resistant heat generator layer 32, on the back of the alumina substrate 31. Moreover, a glass coat 35 as thin as about 30 μm is provided to ensure protection and insulation of the resistant heat generator layer 32. A slide layer 36 made of polyimide is formed at the surface of the alumina substrate 31 in contact with the fixing film 20.

When power is supplied to the resistant heat generator layer 32 in the heater 16 from the electrode, the resistant heat generator layer 32 generates heat, to speedily increase the temperature of the heater 16.

During normal use, upon start of the rotation of the pressure roller 22, the fixing film 20 is started to be followably rotated. In accordance with an increase in temperature of the heater 16, the temperature of the inner surface of the fixing film 20 also is increased. The energization to the heater 16 is controlled by a PID control, and thus, input power is controlled such that the temperature of the inner surface of the fixing film 20 becomes a target value.

In the present embodiment, the fixing film 20 is the cylindrical (endless belt) member having the elastic layer formed on the belt-like member. Specifically, the fixing film 20 is the silicone rubber layer (the elastic layer) with a thickness of about 300 μm formed on the endless belt (a belt base material) formed into a cylindrical shape in a thickness of 30 μm by using SUS (stainless), and further, is covered with a PFA resin tube (an outermost layer) with a thickness of about 30 μm.

The base layer of the fixing film 20 may be polyimide. However, SUS has a heat conductivity about ten times as great as polyimide, thereby achieving a higher on-demand property. Therefore, the base layer of the fixing film 20 is made of SUS in the present embodiment.

The elastic layer of the fixing film 20 is made of a rubber layer having a high heat conductivity. This is because the higher on-demand property is achieved.

A fluororesin layer is formed on the fixing film 20, thus enhancing toner parting properties thereon, so as to prevent any offset phenomenon in which the toner adheres once onto the fixing film 20, and then, moves onto the recording material P again. The fluororesin layer formed on the fixing film 20 is the PFA tube, so that the uniform fluororesin layer can be readily formed.

The heater holder 17 is made of a liquid crystal polymer resin which is high in heat resistance, and has the functions of holding the heater 16 and guiding the fixing film 20. In the present embodiment, Zenite 7755 (trade name) manufactured by DuPont is used as a liquid crystal polymer.

The heater holder 17 and the heater 16 are not bonded (secured) to each other. The heater 16 is inserted into the recess formed at the heater holder 17, and then, is brought into press-contact with the pressure roller 22 via the fixing film 20, thereby secured. The heater holder 17 and the heater 16 are not bonded to each other so that a physical stress is not exerted on the heater even if the relative position of the heater 16 with respect to the heater holder 17 is varied due to a difference in coefficient of thermal expansion between the heater holder 17 and the heater 16.

Figure 4:
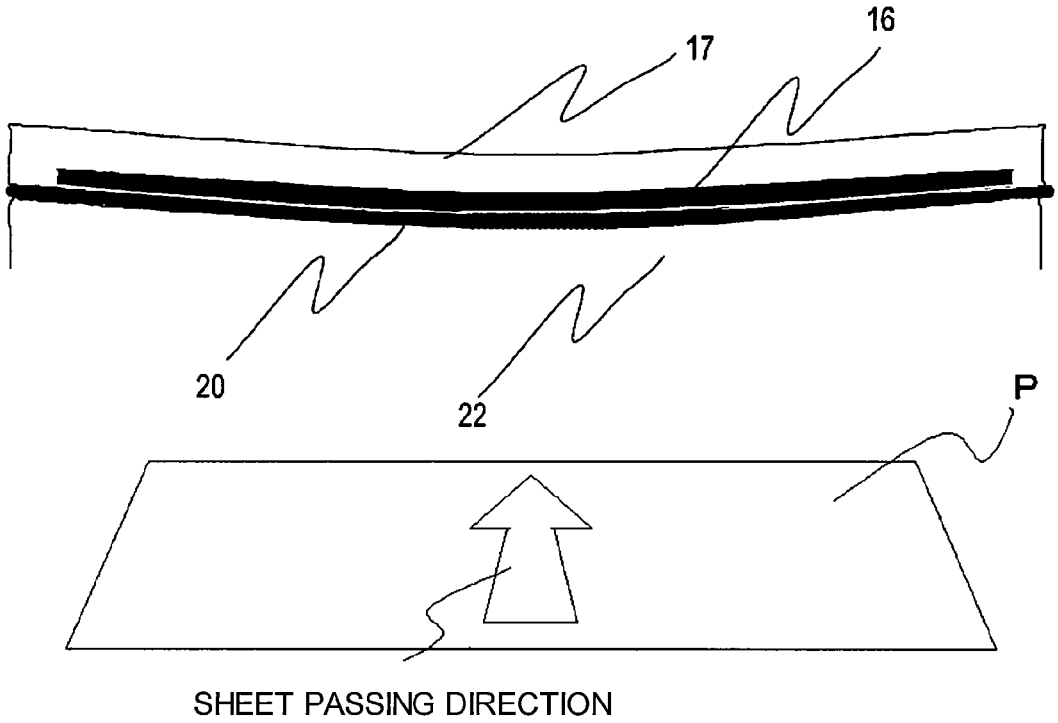
FIG. 4 is a cross-sectional view illustrating the relationship between the heater and a heater holder when a first pressure is exerted on a fixing nip portion.

FIG. 4 is a cross-sectional view illustrating the vicinity of the fixing nip portion (i.e., the vicinity of the recess formed at the heater holder 17) in the longitudinal direction (i.e., as viewed upstream in the sheet passing direction). When the fixing nip portion is defined by pressurizing the heater holder 17 against the pressure roller 22, the pressure roller 22 is flexed. Since a uniform nip is formed in the longitudinal direction while the pressure roller 22 is flexed, the heater holder 17 is formed into a crown shape (i.e., a shape gradually expanded toward the pressure roller to the center from both ends in a direction parallel to the axis of the pressure roller). The crown amount of the heater holder 17 is 500 μm in the present embodiment. As a consequence, the heater 16 held in the recess formed at the heater holder 17 is also deformed into an arcuate shape, as illustrated in FIG. 4, in accordance with the crown shape of the heater holder 17.

Figure 5:
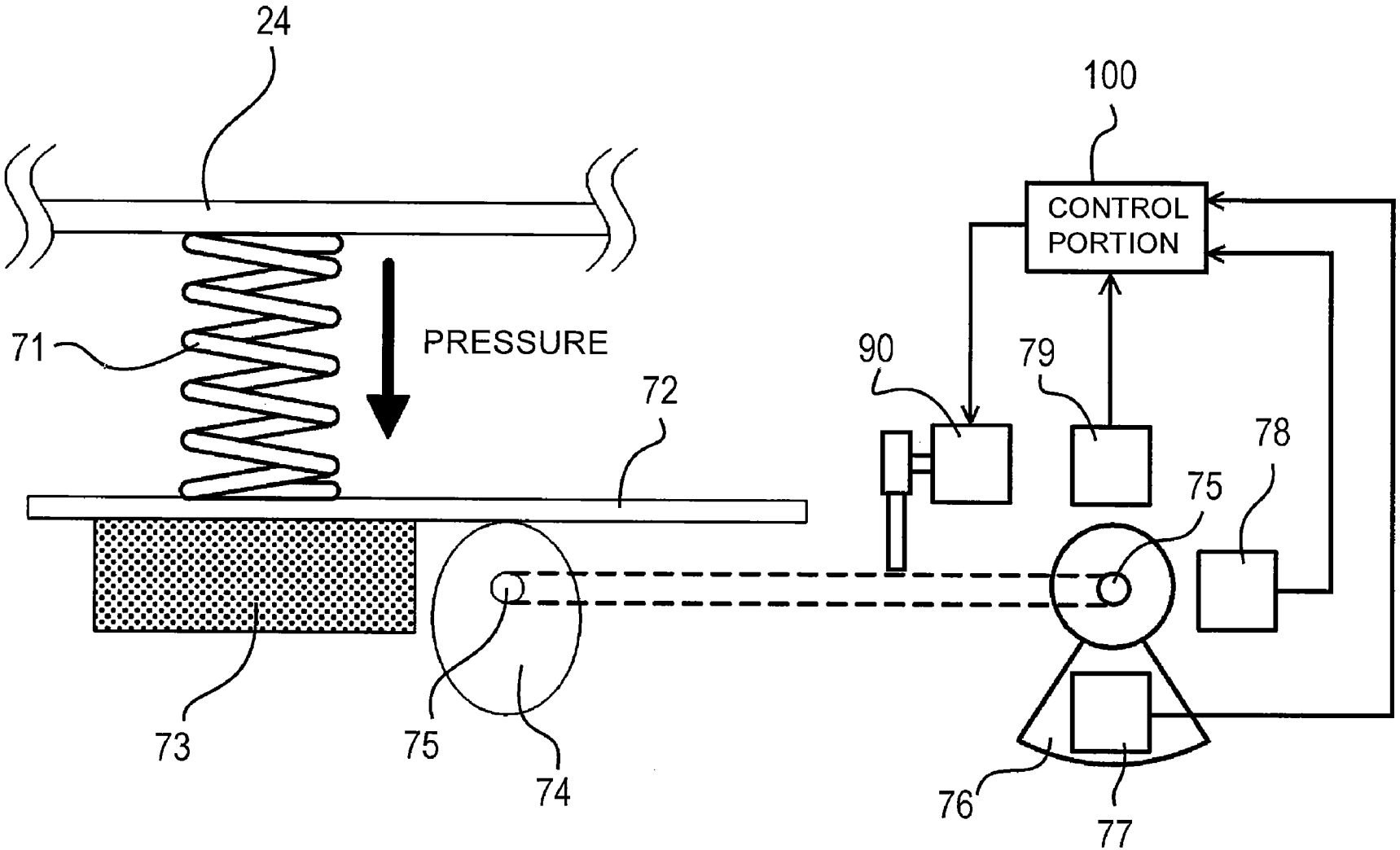
FIG. 5 is a diagram illustrating a pressurized state and a pressure setting portion during normal use.
Figure 6:
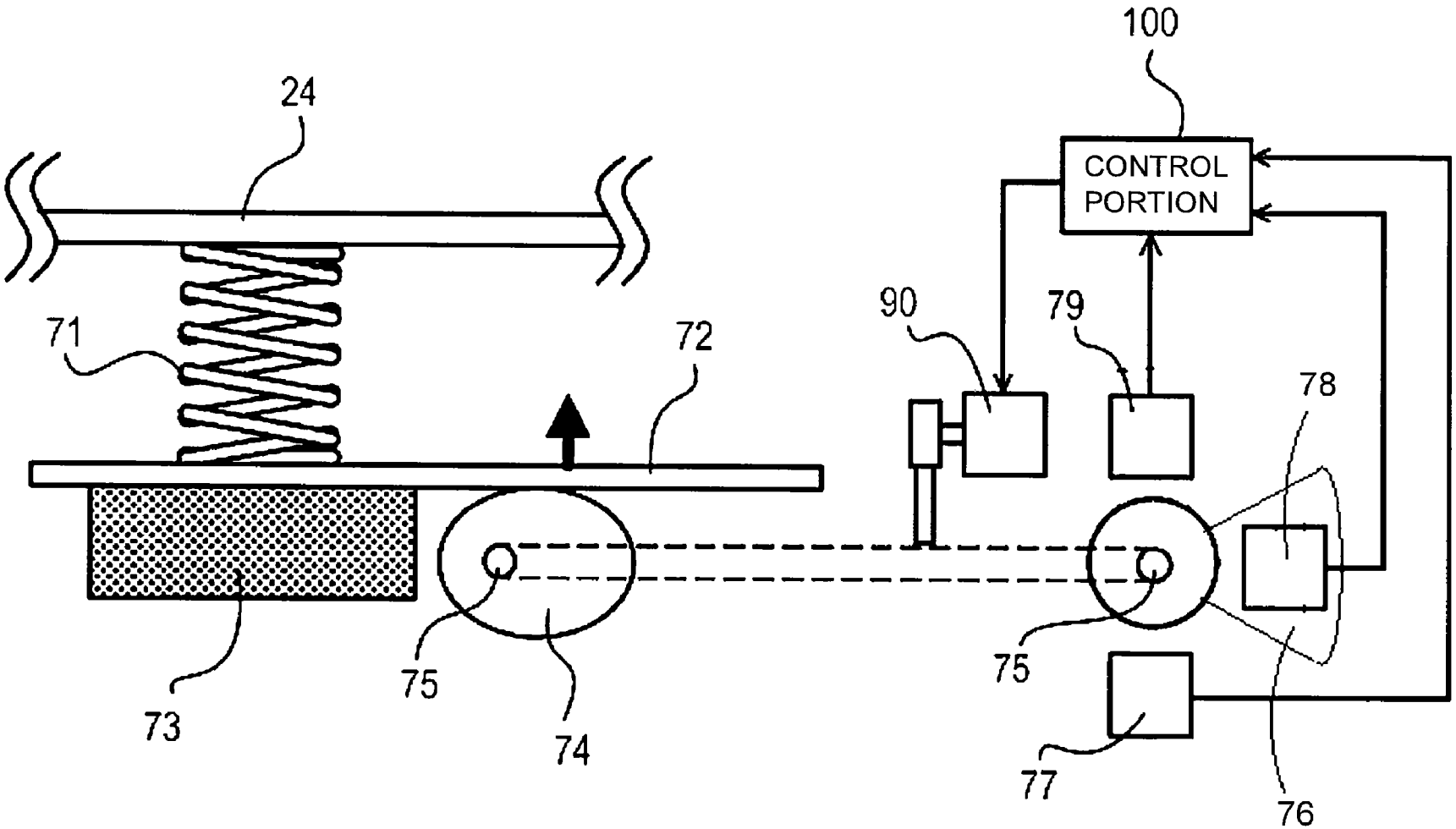
FIG. 6 is a diagram illustrating the pressurized state and the pressure setting portion during jam recovery.
Figure 7:
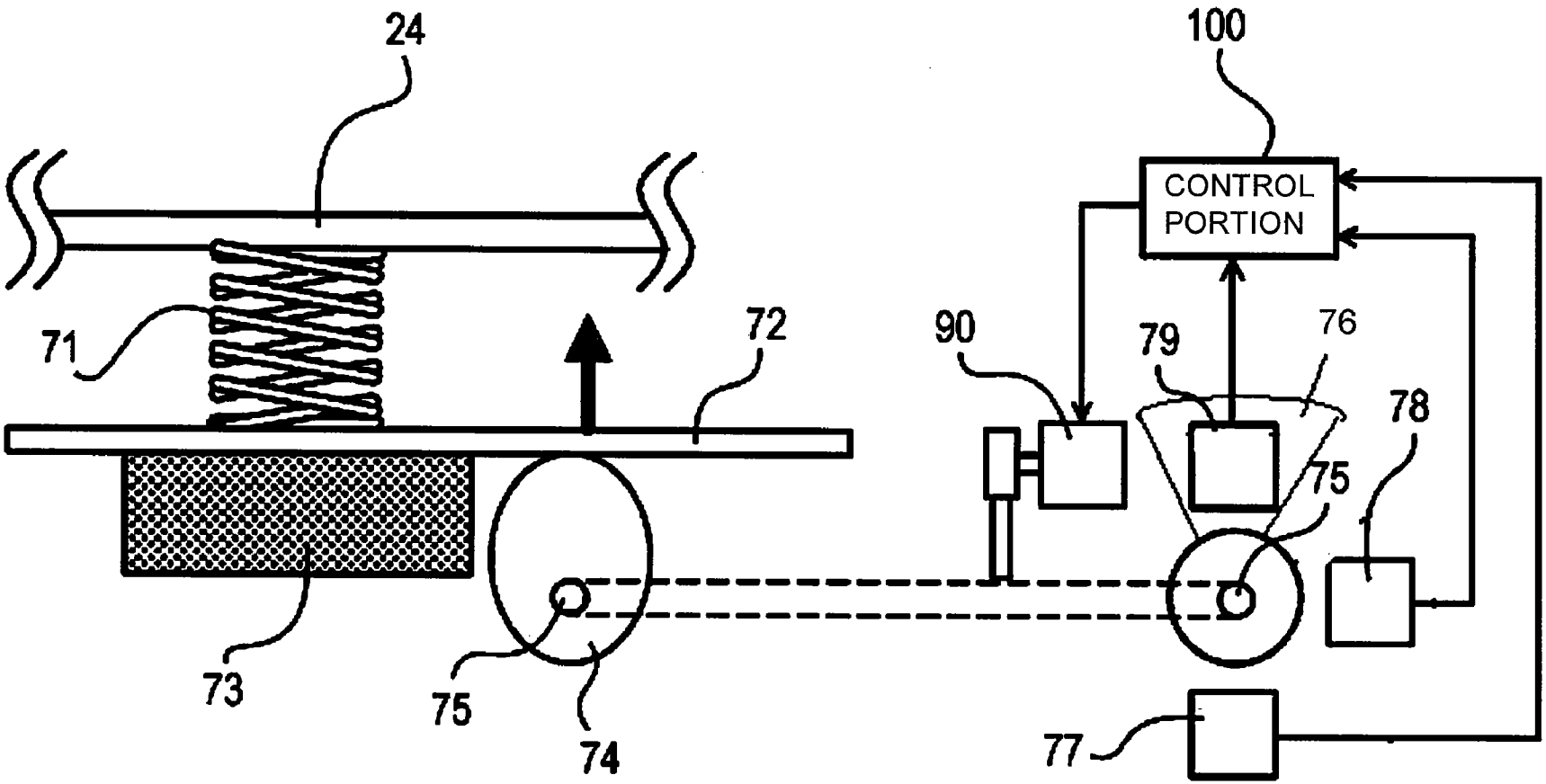
FIG. 7 is a diagram illustrating the pressurized state and the pressure setting portion during non-use.

FIGS. 5 to 7 are diagrams illustrating the pressure mechanism and a pressurized state setting method in the present embodiment. A flange 73 is disposed at each of both longitudinal ends (both ends in FIG. 4) of the heater holder 17. A pressure plate 72 presses the flange 73. The pressure plate 72 is assigned to each of the two flanges 73. The flange 73 which supports the heater holder 17 on both longitudinal sides is pressed against the pressure roller 22 by a pressure spring 71 connected at one end thereof to the frame 24 in the fixing device and connected at the other end thereof to the pressure plate (i.e., a pressure adjusting plate) 72. Cam members 74 are disposed on a side opposite to the pressure spring 71 at the pressure plates 72 on the front and back sides (both longitudinal sides of the heater holder) while holding the pressure plates 72 therebetween. The cam members 74 on the front and back sides are the same in size and shape, and are securely disposed at the same phase with respect to camshafts (i.e., rotary shafts) 75.

The camshaft 75 is rotatably held via a bearing, and is rotated or stopped by a motor. In addition, the camshaft 75 includes a pressurized state detecting member (i.e., rotational position detecting unit) 76 for detecting the pressurized state. The pressurized state is detected and set in response to ON or OFF signals output from three photo sensors (i.e., rotational position detecting unit) 77, 78, and 79 arranged around the pressurized state detecting member 76.

In FIG. 5, the pressurized state detecting member 76 turns off only the photo sensor 77. In this state, a distance between the camshaft 75 and the pressure plate 72 is minimum, and further, the pressure of the pressure plate 72 against the flange 73 is the maximum (in a state in which a first pressure is exerted on the fixing nip portion). The camshaft 75 is rotated at 90° from the state illustrated in FIG. 5 in such a manner that the pressurized state detecting member 76 turns off only the photo sensor 78, such that the cam member 74 is turned into a state illustrated in FIG. 6. As a consequence, the pressure plate 72 is pushed up, and therefore, the pressure can be set lower than the first pressure (in a state in which a third pressure is exerted on the fixing nip portion).

Furthermore, the camshaft 75 is rotated at 90° from the state illustrated in FIG. 6 in such a manner that the pressurized state detecting member 76 turns off only the photo sensor 79, so that the cam member 74 is turned into a state illustrated in FIG. 7 (in a state in which a second pressure is exerted on the fixing nip portion). As a consequence, the pressure plate 72 is further pushed up, and therefore, the pressure can be set lower than the third pressure. In other words, an auxiliary pressure is exerted on the pressure plate 72 by the cam member 74, thereby generating a plurality of pressures. In this manner, the third pressure is smaller than the first pressure and is greater than the second pressure.

A motor 90 is adapted to rotate the cam member 74. Actually, the signals output from the photo sensors 77, 78, and 79 are sent to the control portion (i.e., a pressure setting portion) 100. The control portion 100 controls the rotation of the motor 90 in response to the output signals, thereby adjusting the pressure.

Next, the pressurized states during the normal printing (i.e., fixing, or use), a storage state (non-use), and jam recovery (in the case where the recording material staying inside of the fixing device is removed) will be described below. Here, the non-use state generically refers to the non-printing state such as a case in which the power source of the printer is off, the printer is not used for a long period of time although the power source of the printer is on, or immediately after the completion of the printing. Hereinafter, at least one of these states is referred to as the non-use state.

During the normal printing, the fixing nip portion needs to be wide, and fixing performance can be satisfied by sufficiently supplying the heat and pressure to the recording material. For this, a pressure of 28 kgf (274 N) or higher is required in total.

At the time when the power source in the image forming apparatus is off or in the storage state before the image forming apparatus is shipped, it is necessary to prevent a phenomenon in which the elastic layer of the pressure roller or the fixing film is deformed (an elastic layer deformation phenomenon).

The elastic layer of the pressure roller or the fixing film is more liable to be deformed as the pressure is higher.

FIG. 8 is a table illustrating the check results of formation of deficient images caused by the elastic layer deformation phenomenon after storage for a long period of time under various pressures.

As illustrated in FIG. 8, the elastic layer deformation phenomenon can be prevented when the pressure is 2 kgf (19.6 N) or lower in total in the present configuration.

Figure 9:
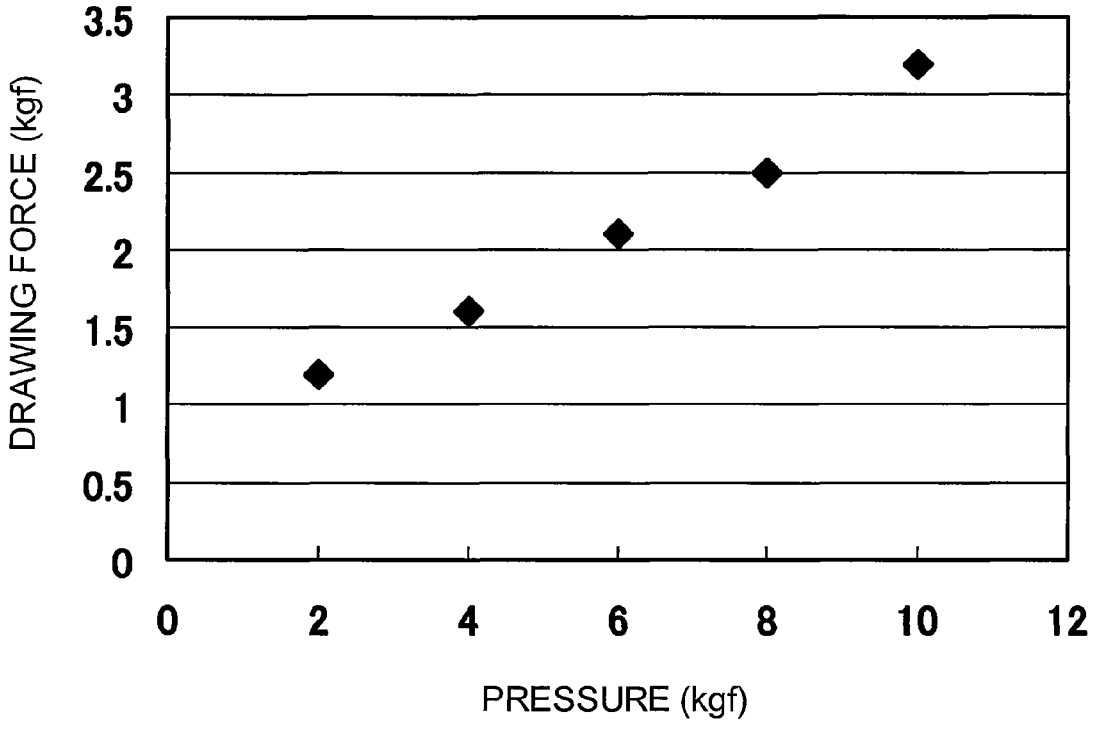
FIG. 9 is a graph illustrating the relationship between the pressure in the fixing portion and force for drawing a recording material.

An upper limit of a pressure during the jam recovery is determined by the force for drawing the recording material staying at the fixing nip portion. FIG. 9 is a graph illustrating the results measured of the force for drawing the recording material when the pressure in a heating/fixing device is varied. The drawing force is set to be 2.5 kgf or lower such that the jam recovery can be readily performed in the present embodiment. As a consequence, the pressure during the jam recovery needs be set to be 8.0 kgf or lower.

Figure 10:
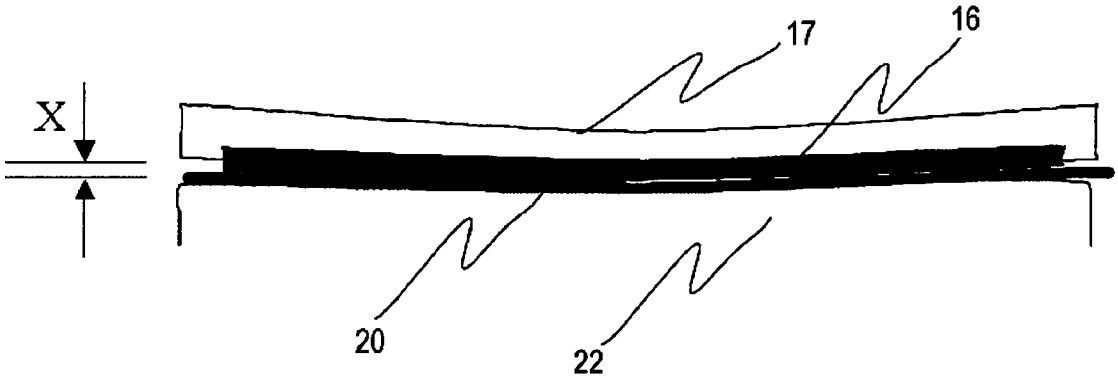
FIG. 10 is a cross-sectional view illustrating the relationship between the heater and the heater holder when a second pressure is exerted on the fixing nip portion.
Figure 11:
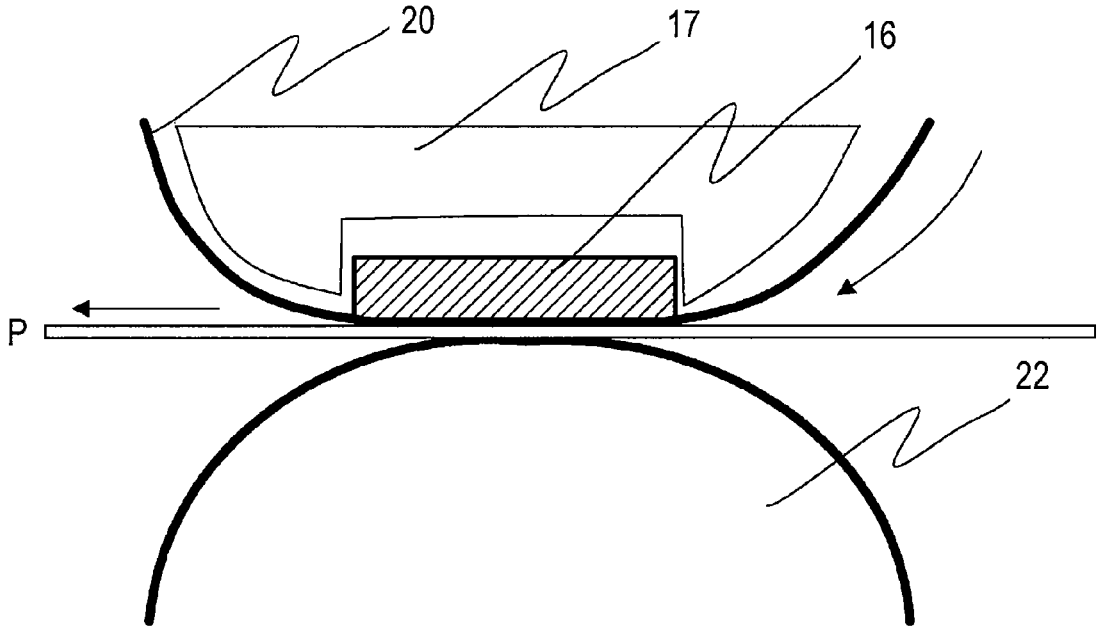
FIG. 11 is a cross-sectional view illustrating the relationship between a heater edge and the inner surface of a film during the jam recovery when the second pressure is exerted on the fixing nip portion.
Figure 13:
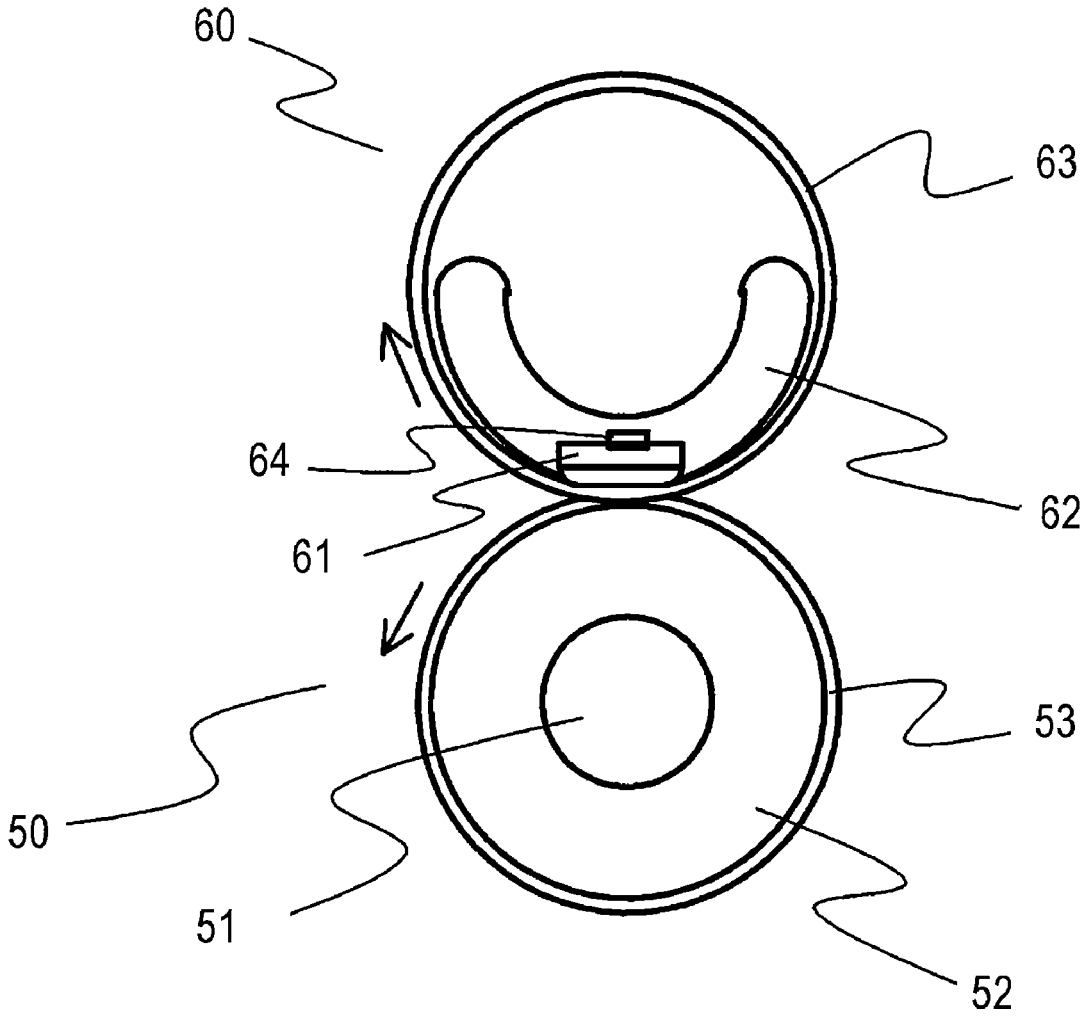
FIG. 13 is a view illustrating the configuration of a conventional fixing device.

However, in the case where the pressure during the jam recovery is set to be 2 kgf (19.6 N) or lower as in the storage state, the edge of the heater 16 may become higher than the heater holder 17 at the longitudinal end of the heater holder, as illustrated in FIG. 10 (the heater 16 may project from the heater holder 17) (as illustrated by the projection amount X of the heater in FIG. 10). This is because the pressure becomes lower so that the pressure roller 22 is slightly flexed, whereas the crown shape of the heater holder 17 remains at 500 μm. In such a case, since the fixing film 20 is rotated when the recording material P staying at the fixing nip portion is removed by the jam recovery, the edge of the heater 16 damages the inner surface of the fixing film 20, as illustrated in FIG. 11.

In the case where the heating/fixing device is continuously used after the jam recovery, during which the edge of the heater 16 damages the inner surface of the fixing film 20, is repeated several tens times, the fixing film may be broken until the lifetime of the heating/fixing device expires. Therefore, the pressure during the jam recovery need be high enough not to float the edge of the heater higher than the heater holder 17 in the entire longitudinal direction.

In the configuration in the present embodiment, it is found that the edge of the heater cannot float higher than the heater holder in the entire longitudinal direction when the pressure is 5.0 kgf or higher. In other words, the amount of the heater projecting from the heater holder 17, when the third pressure is set is smaller than that when the second pressure, is set. Therefore, the breakage of the fixing film due to being in contact with the heater edge can be suppressed by setting the third pressure during the jam recovery even if the fixing film is rotated by the jam recovery.

Thus, the pressure during the jam recovery needs be set to range from 5.0 kgf to 8.0 kgf.

FIG. 12 summarizes the above results.

From the above results, in the present embodiment, the pressure during normal printing (the use of the fixing device) (i.e., the first pressure) is 30 kgf; the pressure during the jam recovery (i.e., the third pressure) is 6.5 kgf; and the pressure during the storage for a long period of time (the non-use of the fixing device) (i.e., the second pressure) is 1.5 kgf. That is, the pressure setting portion 100 sets the first pressure during the fixing operation; in contrast, it sets the second pressure lower than the first pressure when the apparatus is not used. Further, the pressure setting portion sets the third pressure lower than the first pressure and higher than the second pressure when the recording material is jammed. By setting the pressure in the above-described manner, breakage of a sleeve during the jam recovery or the elastic layer deformation phenomenon during the storage for a long period of time can be prevented.

Incidentally, when the power source in the image forming apparatus is switched off, the fixing device 12 is not used, and therefore, the pressure is set to be 1.5 kgf, which is the pressure during storage for a long period of time (the non-use of the fixing device) (i.e., the second pressure) before the power source of each of the component parts is actually turned off. In other words, the control portion (i.e., the pressure setting portion) 100 controls the rotation of the motor 90 in response to the signals from the photo sensors 77, 78, and 79, and rotates the cam member 74 at a predetermined angle, so as to set a pressure of 1.5 kgf, which is the pressure during storage for a long period of time. Thereafter, the power source of each of the component parts is turned off.

In the meantime, when the power source in the image forming apparatus is switched on, the control portion 100 in the image forming apparatus drives the motor 90 in response to the signals from the photo sensors 77, 78, and 79, and thus, sets a pressure of 30 kgf, which is the pressure during the normal printing operation of the fixing device 12.

Moreover, in the case where the image forming apparatus detects the abnormal conveyance of the recording material P by the jam sensors 110 and 111, the control portion 100 controls the motor 90 to rotate the cam member 74, and thus, sets a pressure of 6.5 kgf, which is the pressure during jam recovery.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-244274, filed Sep. 24, 2008, and No. 2009-182097, filed Aug. 5, 2009, which are hereby incorporated by reference herein in their entirety.

What is claimed is:

1. An image forming apparatus for forming a toner image on a recording material, comprising:

an image forming portion which forms a toner image on the recording material;

a fixing portion which fixes, onto the recording material, the toner image formed on the recording material, said fixing portion including an endless belt, a heater in contact with the inner surface of said endless belt, and a pressure roller which defines a fixing nip portion with said heater via said endless belt; and a pressure setting portion which sets a pressure to be exerted on the fixing nip portion, said pressure setting portion setting a first pressure during fixing, setting a second pressure, lower than the first pressure, when said apparatus is not used, and setting a third pressure, lower than the first pressure and higher than the second pressure, when the recording material is jammed.

2. An image forming apparatus according to claim 1, wherein said fixing portion includes a holder which holds said heater, the amount of said heater projecting from said holder when the third pressure is set is lower than that when the second pressure is set.

* * * * *